US007140983B2

(12) United States Patent
Pietsch

(10) Patent No.: US 7,140,983 B2
(45) Date of Patent: Nov. 28, 2006

(54) DIVOT TOOL FOR GOLFER

(76) Inventor: Larry Pietsch, 205 Timberline Rd., Temple, TX (US) 76502

( * ) Notice: Subject to any disclaimer, the term of this patent is extended or adjusted under 35 U.S.C. 154(b) by 0 days.

(21) Appl. No.: 10/403,821

(22) Filed: Mar. 31, 2003

(65) Prior Publication Data

US 2004/0192474 A1 Sep. 30, 2004

(51) Int. Cl.
*A63B 57/00* (2006.01)

(52) U.S. Cl. ..... 473/408

(58) Field of Classification Search ..... 473/408, 473/286, 386; D21/793; 172/378, 379, 172/371; 81/3.45
See application file for complete search history.

(56) References Cited

U.S. PATENT DOCUMENTS

| | | | | | |
|---|---|---|---|---|---|
| 2,577,333 | A | * | 12/1951 | Florence | 211/70.2 |
| D247,279 | S | * | 2/1978 | Marceca | D8/42 |
| D294,218 | S | * | 2/1988 | Johnson | D8/42 |
| 5,085,431 | A | * | 2/1992 | McGuire | 473/386 |
| 5,133,269 | A | * | 7/1992 | Charneski | 175/335 |
| 5,398,927 | A | * | 3/1995 | O'Sullivan | 473/176 |
| 5,441,118 | A | * | 8/1995 | Cruz, Jr. | 172/378 |
| 5,778,986 | A | * | 7/1998 | Davis | 172/378 |
| D481,297 | S | * | 10/2003 | Read et al. | D8/373 |

FOREIGN PATENT DOCUMENTS

| | | | |
|---|---|---|---|
| EP | 0099153 | * | 1/1984 |
| GB | 2091227 | * | 7/1982 |
| GB | 2343176 | * | 3/2000 |

* cited by examiner

*Primary Examiner*—Steven Wong
(74) *Attorney, Agent, or Firm*—Marcus Hammack

(57) ABSTRACT

An improved divot tool for golfers, which tool includes textured or contoured tines for more effectively mechanically engaging soil beneath a divot to thereby more effectively manipulate and de-compact the soil in remediation of a divot.

1 Claim, 2 Drawing Sheets

DIVOT TOOL FOR GOLFER

BACKGROUND OF THE INVENTION

1. Field of the Invention

The present invention relates to tools for golfers, and those relating to the repair of divots in particular.

2. Background Information

The use of tools for repairing divots in a golf green is well known, and the motivations for doing so are likewise well-established in the manners and decorum of traditional golf.

With the exception of certain elaborate divot repair tools (such as that shown in U.S. Pat. No. 6,176,792, issued to Tate), the basic divot repair tool has changed little since its inception.

Basically, every divot tool known to the present inventor involves a pair of tines which extend from a handle. The tines are generally tapered and, to varying degrees, are pointed at their distal ends.

The purpose of using a divot tool is to penetrate the turf beneath a divot, and de-compact the dirt by mechanically agitating it to thereby lift the surface back to its original contour.

Typical use of a divot tool requires multiple manipulations in order to sufficiently de-compact the soil as to adequately repair the divot. The tediousness of using conventional divot tools leads to a problem, beyond golfers simply not enjoying the task of divot repair—some golfers forego the process altogether. This is a definite breach of etiquette in the golf world. Unrepaired divots can alter the travel of a golf ball, beyond anything that could be anticipated through normal visual inspection of the turf, thereby frustrating golfers beyond the normal degree.

Unrepaired divots also represent a real problem for grounds keepers. Because a divot represents a localized compaction of the soil immediately underneath turf surface, roots of the grass are often affected. Left unrepaired, a divot will in many cases lead to death of the turf in the immediately vicinity of the divot, because of the traumatic compaction of the root system.

In view of the above, it would well serve all those associated with the game of golf to provide an improved divot tool for golfers which, because of increased effectiveness and efficiency of use, will afford more effective divot repair, and prompt more consistent attempts at divot repair.

SUMMARY OF THE INVENTION

In view of the above, it is an object of the present invention to provide an improved divot tool for golfers.

It is another object of the present invention to provide an improved divot tool for golfers, which divot tool more effectively manipulates soil than conventional divot tools to thereby more efficiently, effectively, and quickly repair divots.

It is another object of the present invention to provide an improved divot tool for golfers, which divot tool, through use of twisted, helical, spiral-shaped or textured tines, more effectively manipulates soil than conventional divot tools to thereby more efficiently, effectively, and quickly repair divots.

In satisfaction of these and related objects, the present invention provides, at its most basic level, a divot tool with one or more tines which present non-smooth or non-planer surfaces to the soil underlying a divot. In so doing, the divot tool of the present invention more effectively manipulates and agitates soil underlying a divot, thereby more quickly de-compacting the soil. This, in turn, reduces the time and number of steps involved in effectively and properly repairing a divot. This, in turn, makes divot repair less time-consuming and frustrating for golfers who might otherwise conveniently "forget" to repair their divots to the detriment of following golfers.

DETAILED DESCRIPTION OF THE PREFERRED EMBODIMENT

Figure 1:
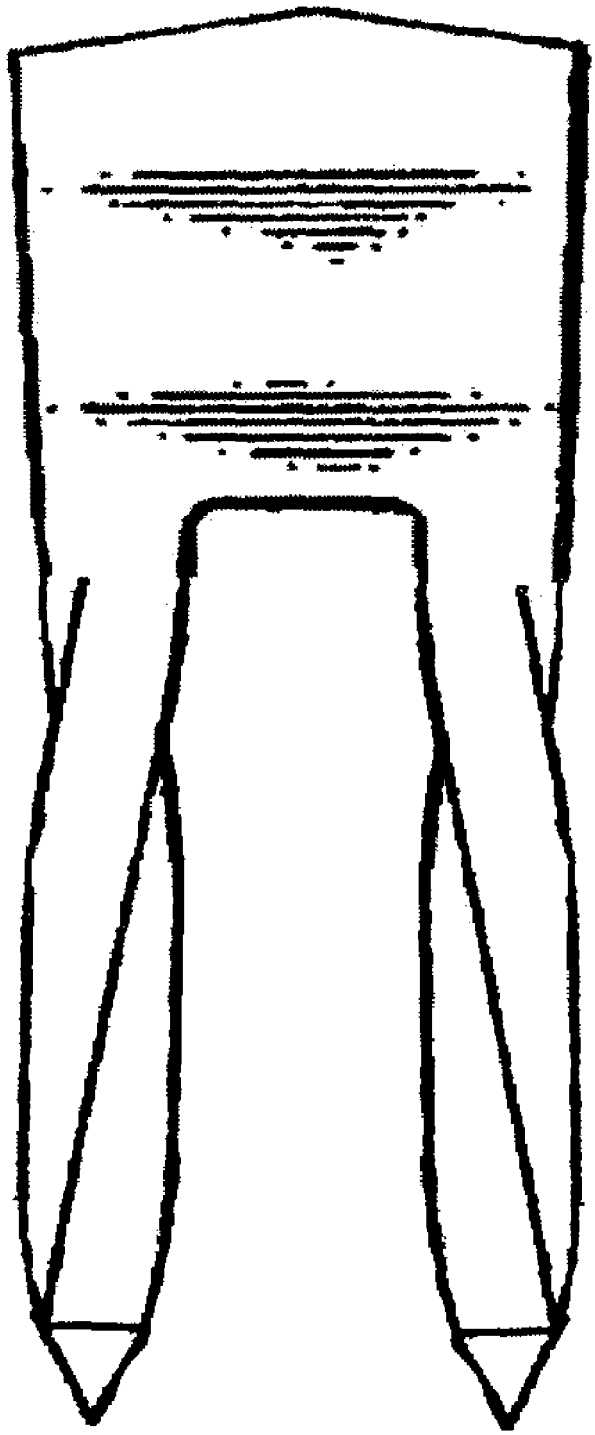
FIG. 1 is an elevational front view of the preferred embodiment of the present invention.

Referring to FIG. 1, the improved divot tool of the present invention is identified generally by the reference number 10. Divot tool 10 includes a handle member 12 and, in the preferred embodiment, and in conformance to convention in this area, includes two tines 14. It should be noted that divot tool 10 may include merely one tine 14, or may even include more than two tines 14. The non-smooth surfaces presented to the soil is the primary departure from prior designs, and use of tine contours to achieve that effect is within the scope of the present invention, whether involving one, two or three tines.

Referring to FIG. 1, the preferred embodiment of the present invention incorporates a substantially planar handle member 12 having tines 14, each extending therefrom along a linear axis. As shown in FIG. 1, the linear axes of tines 14 are substantially parallel to one another throughout their entire length. Each tine 14 is originally formed in a substantially planar or rectangular configuration. Each tine is then rotated along its linear axis into its final shape with the point, or bottom, end exhibiting a 90 to 180 degree rotation with respect to its handle member, or top, end.

Any tine 14 of the present invention will, as already mentioned, include a non-smooth exterior surface. The design shown in FIG. 1 is believed to be the preferred mode, inasmuch as tines 14 of this design are easily manufactured and provide the easiest compromise between ease of insertion into the soil and effective, mechanical agitation of the soil once inserted.

Figure 2:
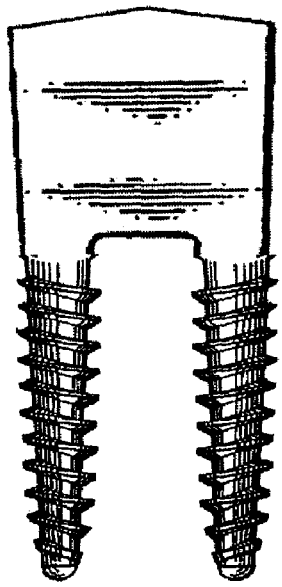
FIG. 2 is an elevational front view of an alternative embodiment of the present invention.
Figure 3:
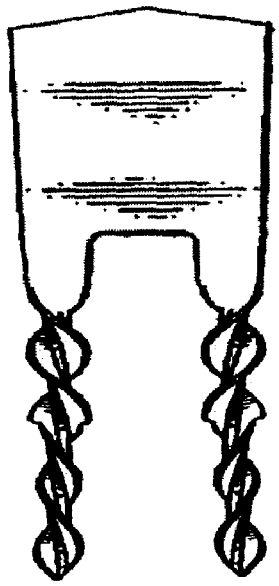
FIG. 3 is an elevational front view of a second alternative embodiment of the present invention.

Referring to FIGS. 2 and 3, examples of alternative designs for tines 14 are shown. While the design shown in FIG. 1 is believed to be preferred, the providing of time contours which more effectively engage soil underneath a divot is at the heart of the present invention. Therefore, while, perhaps, not so easily inserted as the design of FIG. 1, nor removed without dragging more soil or root material than would be desired, the designs of FIGS. 2 and 3 (as well as alternative designs which involve otherwise providing texture or contours to tines 14) are within the scope of the present invention.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An improved divot tool for golfers comprising:

a handle member having a substantially planar configuration; and a first tine member having a proximal end and a distal end, said first tine member extending from said handle member, at said first tine member proximal end, along a linear axis to said tine member distal end in substantially the same plane as said substantially planar configuration of said handle member throughout the entire length of said tine member, said first tine member being formed to exhibit a surface contour wherein said first tine member distal end is rotated along said first tine member linear axis 90 to 180 degrees with respect to said first tine member proximal end; and a second tine member having a proximal and distal end, said second tine member extending from said handle member, at said second tine member proximal end, along a linear axis to said second tine member distal end in substantially the same plane as said substantially planar configuration of said handle member throughout the entire length of said tine member, said linear axes of said first and second tine members being parallel to one another throughout their entire lengths, said second tine member being formed to exhibit a surface contour wherein said second tine member distal end is rotated along said second tine member linear axis 90 to 180 degrees with respect to said second tine member proximal end.

* * * * *